US012194592B2

(12) United States Patent
Shen et al.

(10) Patent No.: US 12,194,592 B2
(45) Date of Patent: Jan. 14, 2025

(54) POLISHING AND LOADING/UNLOADING COMPONENT MODULE

(71) Applicant: HANGZHOU SIZONE ELECTRONIC TECHNOLOGY INC., Zhejiang (CN)

(72) Inventors: Linghan Shen, Zhejiang (CN); Edwardlicang Lee, Zhejiang (CN)

(73) Assignee: HANGZHOU SIZONE ELECTRONIC TECHNOLOGY INC., Zhejiang (CN)

( * ) Notice: Subject to any disclaimer, the term of this patent is extended or adjusted under 35 U.S.C. 154(b) by 499 days.

(21) Appl. No.: 17/207,762

(22) Filed: Mar. 22, 2021

(65) Prior Publication Data

US 2021/0205952 A1 Jul. 8, 2021

Related U.S. Application Data

(63) Continuation-in-part of application No. PCT/CN2019/102950, filed on Aug. 28, 2019.

(30) Foreign Application Priority Data

Sep. 20, 2018 (CN) ..... 201811097868.2
Sep. 20, 2018 (CN) ..... 201811117423.6
Jun. 28, 2019 (CN) ..... 201910573090.6

(51) Int. Cl.
*B24B 37/30* (2012.01)
*B24B 27/00* (2006.01)
(Continued)

(52) U.S. Cl.
CPC ..... *B24B 37/30* (2013.01); *B24B 27/0076* (2013.01); *B24B 37/102* (2013.01); *B24B 37/345* (2013.01); *B24B 53/017* (2013.01)

(58) Field of Classification Search
CPC . B24B 7/228; B24B 27/0023; B24B 27/0069; B24B 27/0076; B24B 37/005;
(Continued)

(56) References Cited

U.S. PATENT DOCUMENTS 6,102,057 A * 8/2000 Vogtmann ..... H01L 21/68 134/179
6,346,038 B1 * 2/2002 Kajiwara ..... B24B 37/345 451/41
(Continued)

FOREIGN PATENT DOCUMENTS

CN 101934496 1/2011
CN 105598827 5/2016
(Continued)

OTHER PUBLICATIONS

Office Action of Korean Counterpart Application, with English translation thereof, issued on May 26, 2023, pp. 1-10.
(Continued)

*Primary Examiner* — Tom Rodgers
*Assistant Examiner* — Steven Huang
(74) *Attorney, Agent, or Firm* — JCIP GLOBAL INC.

(57) ABSTRACT

A polishing and loading/unloading component module comprises a loading/unloading module in the center and two polishing modules on both sides of the loading/unloading module. The loading/unloading module includes a loading/unloading table module which has two loading/unloading positions in a direction perpendicular to the arrangement direction of the two polishing modules. The loading/unloading table module can move back and forth between the two loading/unloading positions, or the two loading/unloading positions are provided with loading/unloading table modules apiece, corresponding to the two polishing modules respectively.

4 Claims, 2 Drawing Sheets

(51) Int. Cl.
*B24B 37/10* (2012.01)
*B24B 37/34* (2012.01)
*B24B 53/017* (2012.01)

(58) Field of Classification Search
CPC ..... B24B 37/10; B24B 37/102; B24B 37/30; B24B 37/34; B24B 37/345; B24B 41/005; B24B 41/06; B24B 41/067; B24B 53/007; B24B 53/017; B24B 55/02
USPC ... 451/9, 10, 11, 41, 54, 285, 287, 339, 444, 451/450
See application file for complete search history.

(56) References Cited

U.S. PATENT DOCUMENTS 6,358,128 B1* 3/2002 Sakurai ..... B24B 37/345 451/287
7,811,153 B1* 10/2010 Blank ..... H01L 21/67742 451/9
2001/0024937 A1 9/2001 Inaba
2001/0024938 A1 9/2001 Inaba
2002/0013122 A1* 1/2002 Sugaya ..... B24B 37/26 451/63
2002/0177386 A1* 11/2002 Smith ..... B24B 37/345 451/5
2004/0072499 A1* 4/2004 Wakabayashi .... H01L 21/67161 451/65
2008/0070488 A1* 3/2008 Fujita ..... B24B 37/04 451/36
2011/0165823 A1* 7/2011 Ide ..... B24B 37/00 451/340
2016/0059376 A1* 3/2016 Yamaguchi ..... B24B 37/345 156/345.12
2018/0315611 A1* 11/2018 Isokawa ..... H01L 21/67219
2019/0157071 A1* 5/2019 Peng ..... H01L 21/02074

FOREIGN PATENT DOCUMENTS

| | | |
|---|---|---|
| CN | 109015314 | 12/2018 |
| CN | 109037101 | 12/2018 |
| CN | 208368479 | 1/2019 |
| CN | 109304665 | 2/2019 |
| CN | 109304670 | 2/2019 |
| CN | 109514421 | 3/2019 |
| CN | 208744518 | 4/2019 |
| CN | 208977580 | 6/2019 |
| CN | 110026879 | 7/2019 |
| CN | 110039441 | 7/2019 |
| CN | 110103119 | 8/2019 |
| DE | 10357505 | 5/2005 |
| KR | 20030067389 | 8/2003 |
| KR | 20040011829 | 2/2004 |

OTHER PUBLICATIONS

"Search Report of Singapore Counterpart Application", issued on Apr. 20, 2022, pp. 1-2.
"Written Opinion of Singapore Counterpart Application", issued on Apr. 20, 2022, pp. 1-9.
"International Search Report (Form PCT/ISA/210)" of PCT/CN2019/102950, mailed on Nov. 29, 2019, with English translation thereof, pp. 1-6.
Office Action of Korean Counterpart Application, with English translation thereof, issued on Dec. 14, 2022, pp. 1-8.

* cited by examiner

POLISHING AND LOADING/UNLOADING COMPONENT MODULE

CROSS-REFERENCE TO RELATED APPLICATION

This application is a continuation in part of international application of PCT application serial no. PCT/CN2019/102950, filed on Aug. 28, 2019, which claims the priority benefits of China application no. 201811117423.6, filed on Sep. 20, 2018, China application no. 201811097868.2, filed on Sep. 20, 2018, and China application no. 201910573090.6, filed on Jun. 28, 2019. The entirety of each of the above mentioned patent applications is hereby incorporated by reference herein and made a part of this specification.

TECHNICAL FIELD

The invention relates to the field of equipment for manufacturing semiconductor integrated circuit chips, in particular to a polishing and loading/unloading component module in a chemical mechanical planarization equipment.

BACKGROUND

Integrated circuits are playing an increasingly important role in various industries and are the cornerstone of the modern information society. With the rapid development of semiconductor industry, the critical dimension of integrated circuits continues to be miniaturized, and the high planarization of semiconductor film surface has a significant impact on the high performance, low cost, and high yield of the device.

Chemical Mechanical Planarization (CMP) equipment is one of the seven key equipments in the field of integrated circuit manufacturing, and its working principle is to finely remove the material on the wafer surface by utilizing the comprehensive balanced actions of the chemical etching of polishing slurry and the mechanical friction of polishing pad. In integrated circuit manufacturing, CMP is first used in the front-end process of chip manufacturing, including planarization, device isolation and device construction, and secondly, in the back-end process of chip manufacturing, including metal interconnection. Furthermore, CMP is also a key technology means in the integrated circuit 3D packaging TSV process. It is precisely because of the relatively diverse and critical applications that CMP has become a standard process and core equipment in integrated circuit manufacturing.

Currently, CMP technology has evolved to be able to integrat such technologies as online measurement, online endpoint detection, cleaning, etc. As the product of integrated circuits keep improving toward miniaturization, multilayer, thinning, and planarization, CMP is also the technology necessary for the transition of wafers from 200 mm to 300 mm in diameter, or even larger, the improvement of productivity, the lowering of manufacturing costs, and the global planarization of substrate.

A typical CMP equipment usually comprises a plurality of polishing units, and auxiliary devices for cleaning, wafer transportation and drying, etc. The polishing unit usually includes a platen, a polishing pad, a polishing head, a polishing arm, a dresser, a polishing slurry arm, etc. The polishing pad, polishing head, polishing arm, dresser, and polishing slurry arm are arranged on the platen according to the processing position. It is found that in actual wafer processing, the spatial arrangement of the polishing units, and the modules such as cleaning module and wafer transfer module, has a great influence on the overall polishing throughput of CMP equipment. Wafer transfer between the polishing unit and the outside, and between the polishing units, is usually realized by a loading/unloading table or a similar device. Regarding the spatial layout of the loading/unloading table and polishing unit, some adopt a square layout of a loading/unloading table and three polishing units, but this technical layout with complicated process since one loading/unloading station needs to provide loading/unloading services for three polishing units. In addition, the four polishing units are arranged side by side, and the wafer transfer is completed by two linear transport mechanisms arranged in the loading/unloadingd area at the end of the planarization equipment and along the arrangement direction of polishing units. The cleaning area lies in the other side of the linear transport mechanism. Each of the aforementioned linear transport mechanisms renders services for two polishing units, and provides two transfer stations for each polishing unit, and the polishing head of polishing unit can load and unload wafers from one of the transfer stations. This layout utilizing the linear arrangement of polishing units has the disadvantage that each polishing unit is equipped with two transfer stations, but the polishing unit only loads and unloads wafers directly from one of them during the polishing process, so the wafer transfer efficiency needs to be improved.

DISCLOSURE OF THE INVENTION

The purpose of the invention is to solve the problems of low wafer transfer efficiency and complex structure of transfer mechanism in the existing CMP equipment, and to propose a polishing and loading/unloading component module for CMP equipment, including a movable loading/unloading module. The modularization of the loading/unloading portion and the polishing portions simplifies the device structure, improves the manufacturing efficiency of the device and reduces the occupation space of the device.

The purposes of the invention are achieved through the following technical solutions. A polishing and loading/unloading component module comprises a loading/unloading module in the center and two polishing modules on both sides of the loading/unloading module. The loading/unloading module includes a loading/unloading table module. The loading/unloading module has two loading/unloading positions in a direction perpendicular to the arrangement direction of the two polishing modules, and the loading/unloading table module can move back and forth between the two loading/unloading positions, corresponding to the two polishing modules respectively.

Loading/unloading table modules are also respectively provided at the two loading/unloading positions, corresponding to the two polishing modules. The loading/unloading module includes a fixed frame, a water tank, a first loading/unloading table module, a second loading/unloading table module, a first loading/unloading table fixed block, a second loading/unloading table fixed block, a first isolation cover, and a second isolation cover. The first loading/unloading table module corresponds to the first loading/unloading position, and the second loading/unloading table module corresponds to the second loading/unloading position. The water tank, the first loading/unloading table fixed block and the second loading/unloading table fixed block are fixedly installed on the fixed frame, and the two isolation covers are fixed respectively on the corresponding loading/ unloading table fixed blocks, so that the lower part of the loading/unloading table module is isolated from the liquid. The first loading/unloading table module and the second loading/unloading table module are respectively fixed on the first loading/unloading table fixed block and the second loading/unloading table fixed block, corresponding to the first loading/unloading position and the second loading/unloading position. The polishing module comprises a fixed platform, a polishing pad, a polishing head, and a rotating shaft, the polishing pad is located on the fixed platform, and the rotating shaft drives the polishing head to rotate to the loading/unloading position.

The loading/unloading module in which the loading/unloading table module can move back and forth between the two loading/unloading positions includes a fixed frame, a water tank, a linear motion module, a loading/unloading table module, a loading/unloading table fixed block, and an isolation cover. The water tank and the linear motion module are fixed on the fixed frame; the loading/unloading table fixed block is fixed on the sliding block of the linear motion module; the loading/unloading table module is fixed on the loading/unloading table fixed block, and the lower part of the loading/unloading table fixed block is fixed with the isolation cover to isolate the lower part of the loading/unloading table module from the liquid, and the linear motion module can make the loading/unloading table module move back and forth between two loading/unloading positions, namely the first loading/unloading position and the second loading/unloading position. A first nozzle module and a second nozzle module are respectively arranged at the two loading/unloading positions of the loading/unloading module, and both the first and the second nozzle modules are fixed on the fixed platform.

The first nozzle module and the second nozzle module are respectively arranged at the edges of the first and the second loading/unloading positions.

The loading/unloading table module can rise and descend in the vertical direction to complete wafer transfer with the polishing head.

For the loading/unloading component module in which the loading/unloading table module can move back and forth between the two loading/unloading positions, the invention further proposes a method for wafer transfer using the polishing and loading/unloading component module, specifically including the following steps.

S1: The loading/unloading table module stops at the first loading/unloading position, waits for the first polishing head corresponding to the said position and carrying the wafer that has been polished in the first stage;

S2: After the first polishing head is transferred to the first loading/unloading position, the loading/unloading table module rises to load the wafer, descends and then moves to the second loading/unloading position;

S3: The first polishing head is cleaned at the position above the first loading/unloading position, and the wafer on the loading/unloading table module at the second loading/unloading position is loaded to the second polishing head to start the polishing in the second stage, and after the second polishing head is transferred above the second polishing pad, a robot arm loads the loading/unloading table module with a new wafer to be polished;

S4: When the first polishing head corresponding to the first loading/unloading position is cleaned, the loading/unloading table module at the second loading/unloading position moves to below the first polishing head at the first loading/unloading position, and then the loading/unloading table module rises, the first polishing head corresponding to the first loading/unloading position loads the wafer to be polished and transfers the wafer to the polishing area for polishing;

S5: The loading/unloading table module at the first loading/unloading position descends and then moves to the second loading/unloading position. At the same time, the second polishing head corresponding to the second loading/unloading position moves to the position above the second loading/unloading position, the loading/unloading table module rises, and loads the wafer that have been polished in the second stage, and then the loading/unloading table module descends and moves from the second loading/unloading position to the first loading/unloading position;

S6: The second polishing head corresponding to the second loading/unloading position is cleaned at the position above the second loading/unloading position. At the same time, the robot arm removes the wafer that has been polished in the second stage from the loading/unloading table module at the first loading/unloading position, and the loading/unloading table module waits for the wafer that has been polished in the first stage on the first polishing head;

S7: After the first polishing head is transferred to the first loading/unloading position, the loading/unloading table module rises and loads the wafer that has been polished in the first stage, then descends and moves to the second loading/unloading position;

S8: Repeat the above steps until all wafers are polished.

For the loading/unloading component module in which the loading/unloading table module can move back and forth between the two loading/unloading positions, the invention further proposes a method for wafer transfer using the polishing and loading/unloading component module, specifically including the following steps.

S1: The loading/unloading table module stops at the first loading/unloading position, waits for the first polishing head corresponding to the said position and carrying the wafer that has been polished by the first polishing pad;

S2: After the first polishing head is transferred to the first loading/unloading position, the loading/unloading table module rises to load the wafer, descends and then moves to the second loading/unloading position;

S3: The first polishing head is cleaned at the position above the first loading/unloading position, and the wafer on the loading/unloading table module at the second loading/unloading position is unloaded by a robot arm, and the robot arm loads the loading/unloading table module with a new wafer to be polished;

S4: When the first polishing head corresponding to the first loading/unloading position is cleaned, the loading/unloading table module at the second loading/unloading position moves to below the first polishing head at the first loading/unloading position, and then the loading/unloading table module rises, the first polishing head corresponding to the first loading/unloading position loads the wafer to be polished and transfers the wafer to the polishing area for polishing;

S5: Repeat the above steps until all wafers are polished.

In the same way, the loading/unloading table module can also stop at the second loading/unloading position first, and the wafer is transferred from the second loading/unloading position to the first loading/unloading position, and the rest of wafer transfer steps are the same as above.

For the loading/unloading component module in which the loading/unloading table module can move back and forth between the two loading/unloading positions, the invention further proposes a method for wafer transfer using the polishing loading/unloading component module, specifically including the following steps.

S1: The loading/unloading table module stops at the first loading/unloading position, waits for the first polishing head corresponding to the said position and carrying the wafer that has been polished;

S2: After the first polishing head is transferred to the first loading/unloading position, the loading/unloading table module rises to load the wafer, and the first polishing head is transferred to the polishing area;

S3: After the wafer on the loading/unloading table module is unloaded by the robot arm, the first polishing head is returned to the first loading/unloading position for cleaning;

S4: After the cleaning of the first polishing head is completed, the first polishing head returns to the polishing area, and the robot arm loads the loading/unloading table module with a new wafer;

S5: Then the loading/unloading table module rises, the first polishing head is transferred to the first loading/unloading position to load the wafer to be polished, and then transferred to the polishing area for polishing, and the loading/unloading table module descends;

S6: Repeat the above steps until all wafers are polished.

In the same way, the loading/unloading table module can also stop at the second loading/unloading position first, and the wafer is transferred from the second loading/unloading position to the first loading/unloading position, and the rest of wafer transfer steps are the same as above.

Similarly, for the loading/unloading component module in which the loading/unloading table modules can also be respectively provided at the two loading/unloading positions, the invention further proposes a method for wafer transfer using the polishing and loading/unloading component module, specifically including the following steps.

S1: The first loading/unloading table module waits for the first polishing head to rotate the wafer polished in the first stage to the first loading/unloading position by the first polishing head rotating shaft;

S2: After the polished wafer is rotated by the first polishing head rotating shaft to the first loading/unloading position, the first loading/unloading table module rises to load the wafer that has been polished in the first stage;

S3: Then the first polishing head returns to above the first polishing pad, the first loading/unloading table module descends, and the robot arm starts to remove the wafer that have been polished in the first stage from the first loading/unloading table module and place the wafer on the second loading/unloading table module at the second loading/unloading position, and the first polishing head returns to the first loading/unloading position for cleaning;

S4: After the cleaning of the first polishing head, the first polishing head returns to above the first polishing pad, while the second polishing head returns to the second loading/unloading position; the second loading/unloading table module rises, the second polishing head takes away the wafer that have been polished in the first stage, the first loading/unloading table module descends, and the second polishing head returns to above the second polishing pad for polishing, and simultaneously, the robot arm places the unpolished wafer on the first loading/unloading table module at the first loading/unloading position;

S5: The first polishing head rotates to the first loading/unloading position to remove the wafer to be polished and then starts polishing. After the polishing of the second polishing head is completed, the second polishing head rotates to the second loading/unloading position to place the wafer polished in the second stage on the second loading/unloading table module, and then rotates back to the second polishing pad, and the robot arm takes away the polished wafer;

S6: The second polishing head rotates back to the second loading/unloading position for cleaning, and after being cleaned, the second polishing head returns to above the second polishing pad, and the first loading/unloading table module waits for the first polishing head to rotate the wafer polished in the first stage to the first loading/unloading position by the first polishing head rotating shaft;

S7: Repeat steps 2 to 6 until all wafers are polished.

For the loading/unloading component module in which the loading/unloading table modules are respectively provided at the two loading/unloading positions, the invention also proposes another method for wafer transfer using the polishing and loading/unloading component module, specifically including the following steps.

S1: The first loading/unloading table module waits for the first polishing head to rotate the polished wafer to the first loading/unloading position by the polishing head rotating shaft;

S2: After the first polishing head is transferred to the first loading/unloading position, the first loading/unloading table module rises and loads the wafer;

S3: The first polishing head (3, 8) returns to the polishing area, and the robot arm starts to remove the polished wafer from the first loading/unloading table module, and the first polishing head returns to the first loading/unloading position for cleaning;

S4: After the cleaning is completed, the first polishing head returns to to the polishing area, and the robot arm loads the first loading/unloading table module with a new wafer to be polished;

S5: Then the first loading/unloading table module rises, the first polishing head is transferred to the first loading/unloading position to load the wafer to be polished, and then transferred to the polishing area for polishing, and then the first loading/unloading table module descends;

S6: Repeat the above steps until all wafers are polished.

In the same way, the second loading/unloading table module waits, at the second loading/unloading position, for the wafer polished by the second polishing head, and the rest of wafer transfer steps are the same as above.

Compared with the existing CMP equipment technology, the present invention has the following beneficial technical effects.

1. The modularization of the loading/unloading portion and the polishing portions enables to assemble into an overall polishing and loading/unloading module; such a layout simplifies the device structure, improves the manufacturing efficiency of the device and reduces the occupation space of the device.

2. In addition, the movement of the loading/unloading table module eliminates the need for the polishing heads to be turned back for cleaning after turning above corresponding polishing pads, saving the transmission time, or by arranging two polishing heads corresponding to the two loading/unloading table modules for wafer transfer, the transmission time can be saved and the efficiency can be significantly improved.

3. The displacement movement of the loading/unloading table module and the separated placement of the cleaning part, together with the robot arm for transferring the wafers, enables the parallel operation of processes between multiple polishing modules, greatly improving the manufacturing efficiency of the device.

4. The overall polishing and loading/unloading module can be expanded freely as needed, and 3 or more such modules can be spliced to further improve the flexibility of wafer manufacturing, improve manufacturing efficiency, reduce equipment space, and increase output.

BRIEF DESCRIPTION OF THE DRAWINGS

The embodiments of the invention are further described with reference to the accompanying drawings, in which.

Figure 1:
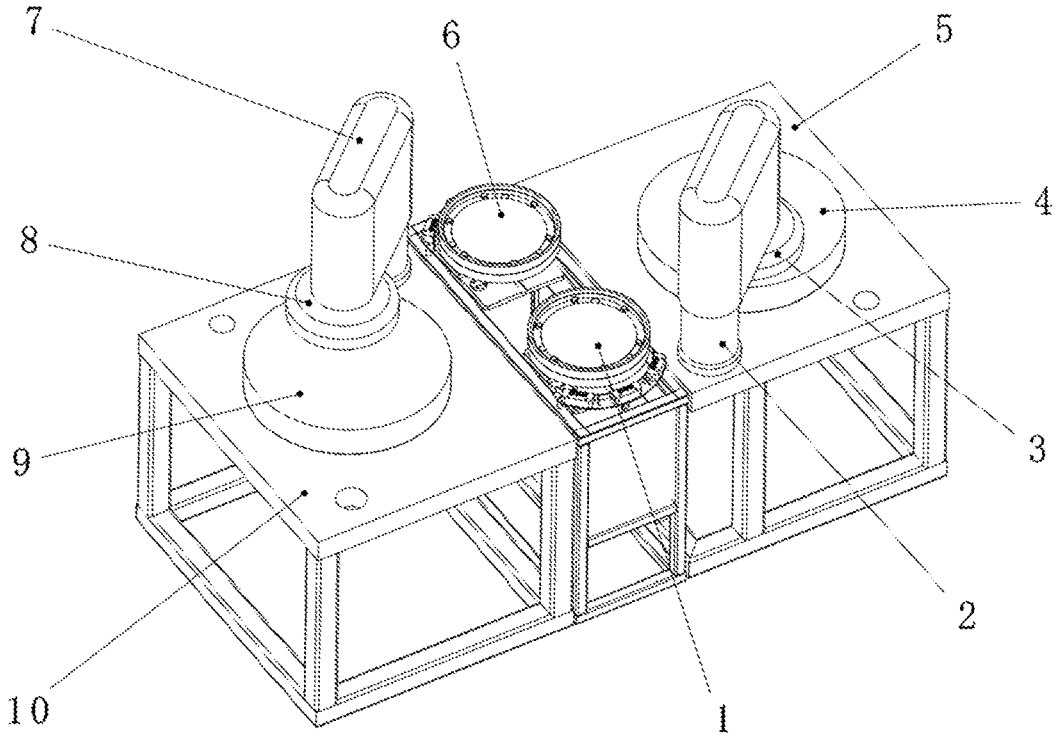
FIG. 1 is a 3D effect diagram of an overall polishing and loading/unloading module of the invention.

The meaning of the signs used in the drawings:

1: First loading/unloading position, 2: First polishing head rotating shaft, 3: First polishing head, 4: First polishing pad, 5: First fixed platform, 6: Second loading/unloading position, 7: Second polishing head rotating shaft, 8: Second polishing head, 9: Second polishing pad, 10: Second fixed platform, 11: Water tank, 12: First isolation cover, 13: First nozzle module, 14: Second loading/unloading table fixed block, 15: Second loading/unloading table module, 16: Second nozzle module, 17: Second isolation cover, 18: First loading/unloading table module, 19: First loading/unloading table fixed block, 20: Fixed frame, 21: Linear motion module, 22: Loading/unloading table module, 23: Loading/unloading table fixed block, 24: Isolation cover.

BEST MODE TO CARRY OUT THE INVENTION

The present invention is described in detail below with reference to the drawings and specific embodiments. The embodiments are implemented on the premise of the technical solution of the present invention, and a detailed implementation mode and specific operation process are given, but the protection scope of the invention is not limited to the following embodiments.

The embodiment provides a polishing and loading/unloading component module for CMP equipment. The polishing and loading/unloading component module comprises one loading/unloading module and two polishing modules, with the layout shown in FIG. 1, including a first loading/unloading position 1, a first polishing head rotating shaft 2, a first polishing head 3, a first polishing pad 4, a first fixed platform 5, a second loading/unloading position 6, a second polishing head rotating shaft 7, a second polishing head 8, a second polishing pad 9, and a second fixed platform 10.

The polishing pad, the polishing rotating shaft and other components are fixed on the fixed platform, and the polishing head is fixed on the polishing rotating shaft. The polishing rotating shaft drives the polishing head to rotate to the loading/unloading position, and after the action, the polishing rotating shaft drives the polishing head to rotate to above the polishing pad for polishing. The first loading/unloading position 1 corresponds to the first polishing head 3, and the second loading/unloading position 6 corresponds to the second polishing head 8.

Figure 2:
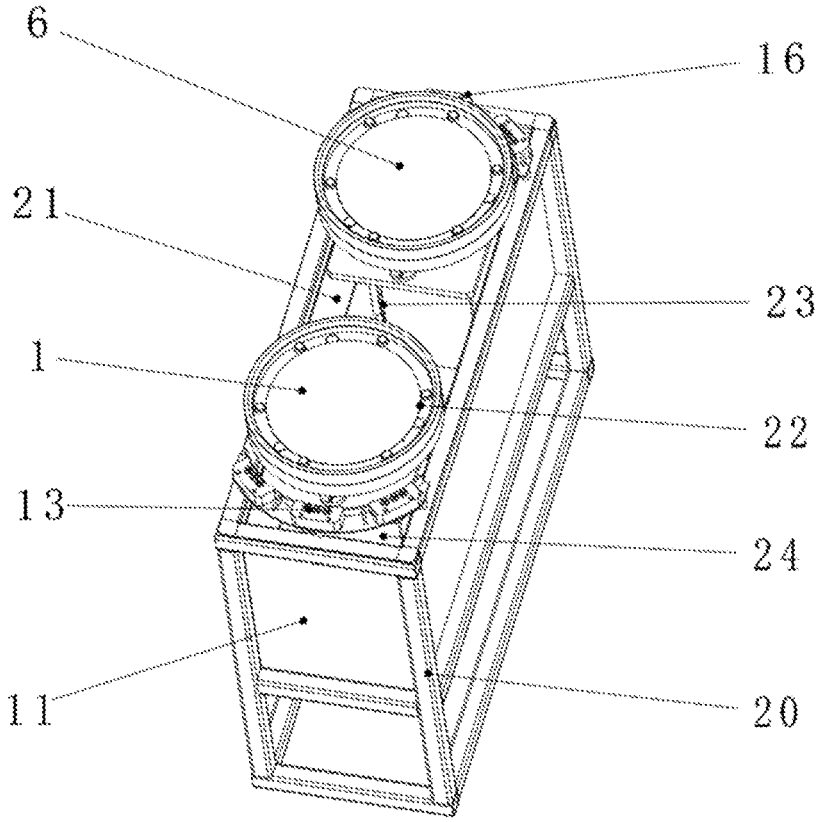
FIG. 2 is a schematic structural diagram of a loading/unloading module in which a loading/unloading table module can move back and forth between two loading/unloading positions.

The structure of the loading/unloading module with a loading/unloading table module that can move back and forth between two loading/unloading positions is shown in FIG. 2, including: the first loading/unloading position 1, the second loading/unloading position 6, a water tank 11, a first nozzle module 13, a linear motion module 21, a second nozzle module 16, a loading/unloading table module 22, a loading/unloading table fixed block 23, an isolation cover 24, and a fixed frame 20. The water tank 11 and the linear motion module 21 are fixed on the fixed frame 20. The loading/unloading table fixed block 23 is fixed on the linear motion module 21, while the loading/unloading table module 22 is fixed on the loading/unloading table fixed block 23, and the lower part of the loading/unloading table fixed block 23 is provided with an isolation cover 24 to isolate the lower part of the loading/unloading table from liquid. The linear motion module 21 can make the loading/unloading table module 22 move back and forth between the first loading/unloading position 1 and the second loading/unloading position 6. The edges of the first loading/unloading position 1 and the second loading/unloading position 6 correspond to the first nozzle module 13 and the second nozzle module 16. The two nozzle modules are fixed on the fixed frame 20.

The process of wafer transfer using the loading/unloading module with the loading/unloading table module that can move back and forth between the two loading/unloading positions is described as follows.

First, the loading/unloading table module 22 stops at the first loading/unloading position 1, waits for the first polishing head 3 corresponding to the first loading/unloading position 1 and carrying the wafer that has been polished in the first stage to be transferred to the first loading/unloading position 1.

The loading/unloading table module 22 rises to load the wafer, and then directly moves to the second loading/unloading position 6, and the first polishing head 3 corresponding to the first loading/unloading position 1 is cleaned above the first loading/unloading position 1. Through the movement of the loading/unloading table module 22, the first polishing head 3 does not need to return from the position above the first polishing pad 4 for cleaning, saving transfer time and improving efficiency.

Simultaneously, the second polishing head 8 is transferred to the second loading/unloading position 6, and then the polished wafer on the loading/unloading table module 22 at the second loading/unloading position 6 is taken away by the second polishing head 8, and the robot arm loads the wafer to be polished on the loading/unloading table module 22 at the second loading/unloading position 6.

When the first polishing head 3 corresponding to the first loading/unloading position 1 is cleaned, the loading/unloading table module 22 at the second loading/unloading position 6 moves to beneath the first polishing head 3 at the first loading/unloading position 1. Subsequently, the loading/unloading table module 22 rises, and the first polishing head 3 corresponding to the first loading/unloading position 1 loads the wafer to be polished and transfers the wafer to the polishing area for polishing, and the polishing of the next wafer is started.

Then the loading/unloading table module 22 in the first loading/unloading position 1 moves to the second loading/unloading position 6. Simultaneously, the second polishing head 8 corresponding to the second loading/unloading position 6 moves to the position above the second loading/unloading position 6, and the loading/unloading table module 22 rises and sucks the polished wafer, and then moves from the second loading/unloading position 6 to the first loading/unloading position 1, and the second polishing head 8 corresponding to the second loading/unloading position 6 is cleaned at the position above the second loading/unloading position 6. This has the advantage that the second polishing pad 8 does not need to return from the position above the second polishing pad 9 for cleaning, saving transfer time and improving efficiency.

Simultaneously, the robot arm takes away the polished wafer on the loading/unloading table module 22 at the first loading/unloading position 1, and loads the loading/unloading table module 22 with the wafer to be polished, and then the loading/unloading table module 22 stops at the first loading/unloading position 1 and waits for the first polishing head 3 corresponding to the first loading/unloading position 1 to unload the polished wafer for starting the cycle again.

Figure 3:
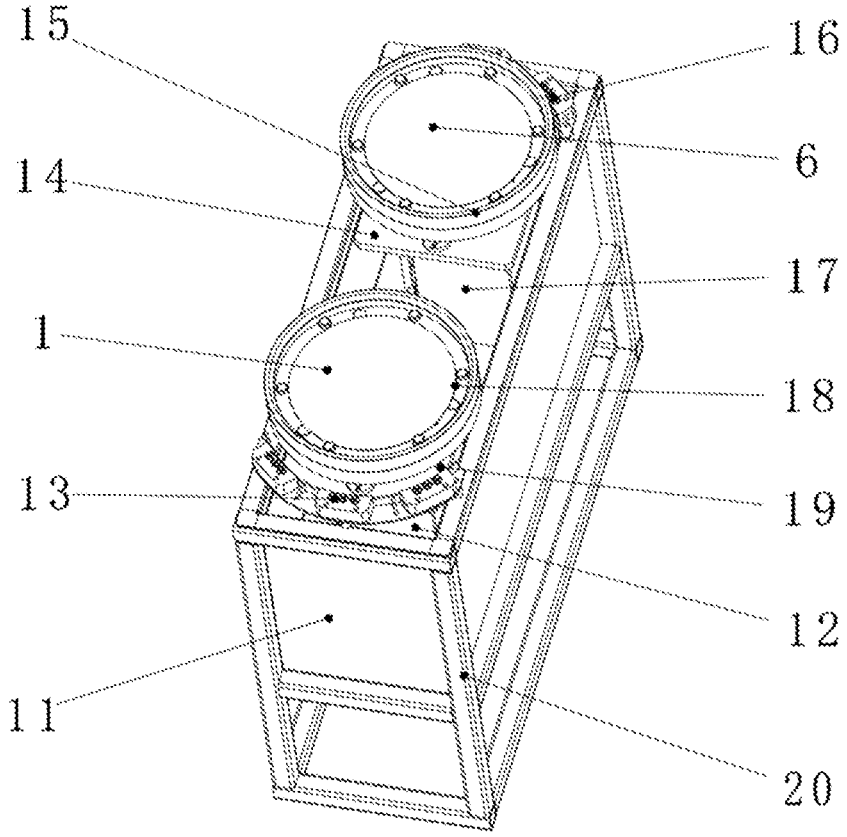
FIG. 3 is a schematic structural diagram of a loading/unloading module in which the loading/unloading table modules are respectively provided at the two loading/unloading positions.

The schematic structural diagram of the loading/unloading module in which the loading/unloading table modules are respectively provided at the two loading/unloading positions is shown in FIG. 3, including the first loading/unloading position 1, the second loading/unloading position 6, the water tank 11, the first isolation cover 12, the first nozzle module 13, the second loading/unloading table fixed block 14, the second loading/unloading table module 15, the second nozzle module 16, the second isolation cover 17, the first loading/unloading table module 18, the first loading/unloading table fixed block 19, and the fixed frame 20. The first loading/unloading table module 18 corresponds to the first loading/unloading position 1, and the second loading/unloading table module 15 corresponds to the second loading/unloading position 6. The water tank 11, the first loading/unloading table fixed block 19 and the second loading/unloading table fixed block 14 are fixed on the fixed frame 20. The isolation cover is fixed on the loading/unloading fixed table to isolate the lower part of the loading/unloading table from the liquid. The loading/unloading table module is fixed on the loading/unloading table fixed block, and the corresponding nozzle module is provided at the edge of the loading/unloading position. All nozzle modules are fixed on the fixed frame 20.

The process of wafer transfer using the loading/unloading module in which the loading/unloading table modules are respectively provided at the two loading/unloading positions is given in detail. At the beginning, the first loading/unloading table module 18 waits for the first polishing head 3 to rotate the wafer polished in the first stage to the first loading/unloading position 1 by the first polishing head rotating shaft 2.

After the polished wafer is rotated by the first polishing head rotating shaft 2 to the first loading/unloading position 1, the loading/unloading table module 18 rises to load the wafer that have been polished.

The first polishing head 3 then returns to above the first polishing pad 4, and the robot arm starts to remove the wafer that has been polished in the first stage from the first loading/unloading table module 18 and place the wafer on the second loading/unloading table module 15 at the second loading/unloading position 6, and the first polishing head 3 returns to the first loading/unloading position 1 for cleaning.

After cleaning, the first polishing head 3 returns to above the first polishing pad 4, while the second polishing head 8 returns to the second loading/unloading position 6, the second loading/unloading table module 15 rises, and the second polishing head 8 takes away the wafer that has been polished in the first stage and simultaneously, the robot arm places the unpolished wafer on the first loading/unloading table module 18 at the first loading/unloading position 1. The transfer of wafers through two polishing heads corresponding to two loading/unloading table modules saves wafer transfer time and improves efficiency.

Subsequently, the second polishing head 8 returns to above the second polishing pad 9 for polishing. The first polishing head 3 rotates to the first loading/unloading position 1 to remove the wafer to be polished and then starts polishing. After the polishing of the second polishing head 8 is completed, the second polishing head 8 rotates to the second loading/unloading position 6 to place the wafer polished in the second stage on the second loading/unloading table module 15, and then rotates back to the second polishing pad 9. The robot arm takes away the polished wafer, and the second polishing head 8 rotates back to the second loading/unloading position 6 for cleaning, and the cleaned second polishing head 8 returns to above the second polishing pad 9. The first loading/unloading table module 18 waits for the wafer on the first polishing head 3 at the first loading/unloading position 1 for starting the cycle.

Advantages of the wafer loading/unloading component structure of the present invention include the following. The modularization of the loading/unloading portion and polishing portion enables to assemble into the layout in FIG. 1. The layout simplifies the device structure, improves the manufacturing efficiency of the device and reduces the occupation space of the device. Furthermore, the layout can be expanded freely as needed, and 3 or more modules in the layout shown in FIG. 1 can be spliced to further improve the flexibility of wafer manufacturing, improve manufacturing efficiency, reduce equipment space, and increase output. In addition, the displacement movement of the loading/unloading table module and the separated placement of the cleaning part, together with the robot arm for transferring the wafers, enables the parallel operation of processes between multiple polishing modules, greatly improving the manufacturing efficiency of the device.

The preferred embodiments of the present invention are described in detail above. It should be understood that those of ordinary skill in the art can make many modifications and changes according to the concept of the invention without creative work. Therefore, all technical solutions that can be obtained by those skilled in the art through logical analysis, reasoning or limited experiments based on the concept of the invention on the basis of the prior art, shall fall within the protection scope determined by the claims.

What is claimed is:

1. A method for wafer transfer using a polishing and loading/unloading component module, wherein the polishing and loading/unloading component module comprises a loading/unloading module in a center of the polishing and loading/unloading component module and two polishing modules, wherein one of the two polishing modules is on one side of the loading/unloading module, and another one of the two polishing modules is on another side of the loading/unloading module opposite to the one side, wherein the loading/unloading module comprises one loading/unloading table module, and a linear motion module;

the said one loading/unloading table module comprises a loading/unloading stage configured for holding a wafer, and a first loading/unloading position and a second loading/unloading position, wherein the loading/unloading stage moves between the first loading/unloading position and the second loading/unloading position;

the linear motion module comprises a sliding block, and a loading/unloading stage holder configured for positioning the loading/unloading stage of the said one loading/unloading table module, such that the said one loading/unloading table module is fixed on the sliding block of the linear motion module, and the sliding block connecting the first loading/unloading position and the second loading/unloading position enables the said one loading/unloading table module to move between the first loading/unloading position and the second loading/unloading position, the first loading/unloading position and the second loading/unloading position are in a direction perpendicular to an arrangement direction of the two polishing modules, and the method comprises following steps:

S1: the said one loading/unloading table module stopping at the first loading/unloading position, waiting for a first polishing head corresponding to the first loading/unloading position and carrying a first wafer that has been polished in a first stage;

S2: after the first polishing head is transferred to the first loading/unloading position, the first wafer is loaded to the said one loading/unloading table module, and the said loading/unloading table module is moved to the second loading/unloading position;

S3: the first polishing head being cleaned at a position above the first loading/unloading position, and the first wafer on the said one loading/unloading table module at the second loading/unloading position being loaded to a second polishing head to start the polishing in a second stage, and after the second polishing head is transferred above a second polishing pad, loading a second wafer to be polished to the said one loading/unloading table module;

S4: when the first polishing head corresponding to the first loading/unloading position being cleaned, the said one loading/unloading table module at the second loading/unloading position moving to below the first polishing head at the first loading/unloading position, and then the said one loading/unloading table module moving to above the first loading/unloading position, the first polishing head corresponding to the first loading/unloading position loading the second wafer to be polished and transferring the second wafer to be polished to a polishing area for polishing;

S5: the said one loading/unloading table module at the first loading/unloading position moving to below the first loading/unloading position and then moving to the second loading/unloading position, while the second polishing head corresponding to the second loading/unloading position moving to a position above the second loading/unloading position, the said one loading/unloading table module moving to above the second loading/unloading position, and loading the first wafer that has been polished in the second stage, and then the said one loading/unloading table module moving to below the second loading/unloading position and moving from the second loading/unloading position to the first loading/unloading position;

S6: the second polishing head corresponding to the second loading/unloading position being cleaned at the position above the second loading/unloading position, while removing the first wafer that has been polished in the second stage from the said one loading/unloading table module at the first loading/unloading position, and the said one loading/unloading table module waiting for the second wafer that has been polished in the first stage on the first polishing head;

S7: after the first polishing head is transferred to the first loading/unloading position, the said one loading/unloading table module moving to above the first loading/unloading position to load the second wafer that has been polished in the first stage, and then moving to the second loading/unloading position;

S8: repeating the preceding steps until all wafers are polished, wherein the polishing module comprises a fixed platform, a polishing pad, a polishing head, and a rotating shaft, the polishing pad is located on the fixed platform, and the rotating shaft drives the polishing head to rotate to at least one of the two loading/unloading positions.

2. The method according to claim 1, wherein the first loading/unloading position and the second loading/unloading position are respectively provided with a first nozzle module and a second nozzle module, and both the first nozzle module and the second nozzle module are fixed on a fixed frame.

3. The method according to claim 2, wherein the first nozzle module and the second nozzle module are respectively arranged at edges of the first loading/unloading position and the second loading/unloading position.

4. The method according to claim 1, wherein the said one loading/unloading table module is moved to above or below the first loading/unloading position or the second loading/unloading position in a vertical direction to complete wafer transfer with a polishing head.

* * * * *